US006383730B1

(12) United States Patent
Maskasky et al.

(10) Patent No.: US 6,383,730 B1
(45) Date of Patent: May 7, 2002

(54) PREPARATION OF HIGH CHLORIDE PHOTOGRAPHIC EMULSIONS WITH STARCH PEPTIZER

(75) Inventors: Joe E. Maskasky; Victor P. Scaccia, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/731,454

(22) Filed: Dec. 7, 2000

(51) Int. Cl.[7] ..... G03C 1/035
(52) U.S. Cl. ..... 430/569; 430/567; 430/641
(58) Field of Search ..... 430/567, 569, 430/641

(56) References Cited

U.S. PATENT DOCUMENTS

| | | | | |
|---|---|---|---|---|
| 5,275,930 A | | 1/1994 | Maskasky | |
| 5,284,744 A | | 2/1994 | Maskasky | |
| 5,547,827 A | | 8/1996 | Chen et al. | |
| 5,550,013 A | | 8/1996 | Chen et al. | |
| 5,607,828 A | | 3/1997 | Maskasky | |
| 5,726,008 A | * | 3/1998 | Maskasky | 430/569 |
| 5,733,718 A | * | 3/1998 | Maskasky | 430/639 |
| 5,736,310 A | | 4/1998 | Chen et al. | |
| 5,783,378 A | * | 7/1998 | Mydlarz et al. | 430/567 |
| 5,908,740 A | * | 6/1999 | Maskasky et al. | 430/569 |
| 5,976,778 A | * | 11/1999 | Brust et al. | 430/569 |
| 6,027,869 A | | 2/2000 | Maskasky et al. | |
| 6,090,536 A | | 7/2000 | Maskasky et al. | |

OTHER PUBLICATIONS

"Das Redoxverhalten des latenten Innenbildes", R. Matejec and E. Moisar, (with English translation, "The redox behavior of the latent interior image"), Photographische Korrespondenz, vol. 101 (4), 1965, pp. 53–60.

T. Tani, "Photographic Effects Of Electron And Positive Hole Traps In Silver Halides", Photographic Science And Engineering, vol. 15, No. 3, May–Jun. 1971, pp. 181–188.

Roy L. Whistler and Richard Schweiger, "Oxidation Of Amylopectin With Hypochlorite At Different Hydorgen Ion Concentrations", J. Am. Chem. Soc., vol. 79, pp. 6460–6464, 1957.

K. F. Patel, H. U. Mehata, and H. C. Srivastava, "Kinetics And Mechanism Of Oxidation Of Starch With Sodium Hypochlorite", Journal of Applied Polymer Science, vol. 18, p. 289–399, 1974.

Jehudah Eliassaf and Jeanine Bel–Ayche, "The Interaction Of Starch With Bromine In Acid Solution", Carbohydrate Research, vol. 5, pp. 470–476, 1967.

B. Perlmutter–Hayman and Y. Weissmann, "The Kenetics Of Ethanol And Of Acetaldehyde By Bromine In Aqueous Solution", J. Am. Chem. Soc. vol. 84, pp. 2323–2326, 1962.

B. Perlmutter–Hayman and A. Persky, "The Kenetics Of The Oxdiation Of D–Glucose By Bromine And By Hypobromous Acid", J. Am. Chem. Soc. vol. 83, pp. 276–279, 1960.

B. Perlmutter–Hayman and A. Persky,"The Influence Of Ionic Strength And Of Temperature On The Rate Of Oxidation Of D–Glucose By Bromine", J. Am. Chem. Soc. vol. 82, pp. 3809–3810, 1960.

US Patent application No. 09/731,445, filed Dec. 7,2000, titled "Preparation Of High Bromide Photographic Emulsions With Starch Peptizer And Oxidizing Agent", of Maskasky et al.

US Patent application No. 09/731,446, filed Dec. 7, 2000, titled "Preparation Of High Bromide Photographic Emulsions With Starch Peptizer", of Maskasky et al.

* cited by examiner

*Primary Examiner*—Mark F. Huff
*Assistant Examiner*—Amanda C. Walke
(74) *Attorney, Agent, or Firm*—Andrew J. Anderson

(57) ABSTRACT

A process for precipitating a high chloride silver halide emulsion in an aqueous medium is disclosed comprising growing nucleated silver halide grains in a reaction vessel in the presence of a peptizer comprising a water dispersable starch to form high chloride radiation-sensitive silver halide grains, wherein the majority of grain growth in the reaction vessel is performed at a pH of less than 3.5. Growth of high chloride silver halide emulsion grains in the presence of a starch peptizer at low pH in accordance with the invention results in emulsion grains with lower fog, even in the absence of the use of strong oxidizing agents and antifoggants during grain precipitation.

15 Claims, No Drawings

PREPARATION OF HIGH CHLORIDE PHOTOGRAPHIC EMULSIONS WITH STARCH PEPTIZER

FIELD OF THE INVENTION

The invention relates to silver halide photography. More specifically, the invention relates to radiation-sensitive high chloride emulsions prepared in the presence of starch peptizer and photographic elements employing such emulsions.

BACKGROUND OF THE INVENTION

The most widely used forms of photographic elements are those that contain one or more silver halide emulsions. Silver halide emulsions are usually prepared by precipitating silver halide in the form of discrete grains (microcrystals) in an aqueous medium. An organic peptizer is incorporated in the aqueous medium to disperse the grains. Varied forms of hydrophilic colloids are known to be useful as peptizers, but the overwhelming majority of silver halide emulsions employ gelatino-peptizers. A summary of conventional peptizers, including gelatino-peptizers, is provided by *Research Disclosure*, Vol. 389, September 1996, Item 38957, II. Vehicles, vehicle extenders, vehicle-like addenda and vehicle related addenda, A. Gelatin and hydrophilic colloid peptizers. *Research Disclosure* is published by Kenneth Mason Publications, Ltd., Dudley House, 12 North St., Emsworth, Hampshire P010 7DQ, England. The term "vehicle" includes both the peptizer used to disperse silver halide grains as they are being formed and the binder used in coating emulsion and processing solution penetrable layers of photographic elements. Gelatin and gelatin derivatives are commonly employed to perform the functions of both peptizer and binder.

Silver halide emulsions having high chloride contents, i.e., greater than 50 mole percent chloride based on silver, are known to be very desirable in image-forming systems due to the high solubility of silver chloride which permits short processing times and provides less environmentally polluting effluents. It is also known that high chloride emulsions are easily fogged during their precipitation and subsequent handling, as their greater reducibility and developability relative to high bromide emulsions make them highly susceptible to fog formation. The control of fog formation during the formation of light-sensitive silver halide emulsions, as well as during the spectral/chemical sensitization of those emulsions, during the preparation of silver halide compositions prior to coating on an appropriate support, and during the aging of such coated silver halide compositions, has been attempted by a variety of means. Mercury-containing compounds, such as those described in U.S. Pat. Nos. 2,728,663, 2,728,664, and 2,728,665, have been used as additives to control fog. Thiosulfonates and thiosulfonate esters, such as those described in U.S. Pat. Nos. 2,440,206, 2,934,198, 3,047,393, and 4,960,689, have also been employed. Organic dichalcogenides, for examples the disulfide compounds described in U.S. Pat. Nos. 1,962,133, 2,465,149, 2,756,145, 2,935,404, 3,184,313, 3,318,701, 3,409,437, 3,447,925, 4,243,748, 4,463,082, and 4,788,132 have been used not only to prevent formation of fog but also as desensitizers and as agents in processing baths and as additives in diffusion transfer systems. Unfortunately, such fog reducing compounds are not without drawbacks. Mercury-containing compounds, while generally thought to be the most effective antifoggants, can diminish the sensitivity of silver halide emulsions, can cause a deterioration in the stability of the latent image, and are environmentally harmful even at relatively low concentrations. The elimination of mercury-containing compounds from photographic compositions is highly desirable. Thiosulfonate salts can cause large sensitivity losses if not used with an excess of sulfinate salt. Many of the organic disulfide compounds need to be added to silver halide compositions from typical organic solvents because of their high water insolubility. While many mild oxidizing agents have been reported to be beneficial in controlling fog, none appear to perform as well as mercury.

While gelatin is by far the most widely used peptizer in the photographic emulsion arts, it has been shown that water dispersable starches may also be used as a peptizer to make silver halide emulsion grains (U.S. Pat. No. 5,284,744), and in particular high bromide {111} (U.S. Pat. Nos. 5,604,085, 5,620,840, 5,667,955, 5,691,131, and 5,733,718) and high chloride {100} (U.S. Pat. No. 5,607,828) tabular grains. It has also been observed, however, that employing a starch peptizer for emulsion grain precipitation may result in somewhat higher minimum densities (i.e., fog) than when a gelatino-peptizer is substituted, even when conventional antifoggants and stabilizers are present in the emulsion. It is likely a result of silver reduction by the starch aldehyde groups. This type of reduction is well known and is the basis for a test for aldehyde groups at ammonium hydroxide pH known as the Tollens' test or "silver mirror" test:

$$R—CHO+2Ag(NH_3)_2^{+}+3OH^{-} \leftrightharpoons 2Ag+R—COO^{-}+4NH_3+2H_2O$$

Starch aldehyde groups can come about from three sources: (1) starch, being a polymer of glucose, a reducing sugar, has a natural aldehyde group at one end of each polymer strand, (2) hydrolysis of a polymer strand would make a new terminal aldehyde group in addition to the previous aldehyde group, and (3) partial oxidation of a C—C bond in the glucopyranose ring can create two new aldehyde groups at the carbon bond scission point.

Fog may be reduced in starch precipitated emulsions by treating the emulsion (either during or after precipitation) with an oxidizing agent as disclosed, e.g., in U.S. Pat. Nos. 6,027,869 and 6,090,536, where the oxidizing agent establishes an oxidation potential capable of oxidizing metallic silver. Specifically preferred oxidizing agents employed during the preparation of high bromide emulsions precipitated with starch peptizers are halogens, e.g., bromine ($Br_2$) or iodine ($I_2$), and bromine or iodine generating agents. Elemental bromine and bromine-generating agents (such as an acidified solution of sodium hypochlorite containing sodium bromide) have been found to be particularly effective oxidants. When bromine or iodine is used as an oxidizing agent, the bromine or iodine is reduced to $Br^-$ or $I^-$. These halide ions can simply remain with other excess halide ions in the dispersing medium of the emulsion or be incorporated within the high bromide grains without adversely influencing photographic performance.

The reaction of starch and oxidizing agents such as bromine at typical pH values conventionally used for gelatin peptized emulsions, however, can rapidly deplete the oxidizing agent, requiring the frequent addition of relatively high levels of oxidant to maintain desired high oxidation potentials sufficient for bleaching internal grain fog centers. Health concerns have arisen concerning the handling and generation of significant amounts of volatile halides during emulsion grain manufacture. Further, high chloride emulsions create a more difficult challenge compared to high bromide emulsions in that using bromine to control fog would limit possible emulsion compositions to those containing some bromide throughout the grain structure. The alternative use of chlorine would be impractical and very dangerous.

Accordingly, to enjoy the advantages of starch as a peptizing agent for high chloride emulsions, it would be desirable to provide a high chloride emulsion grain precipitation process employing starch peptizer which would enable a reduction in the amount of fog generation in the precipitated emulsion grains without the need for the use of strong oxidants or environmentally undesirable antifoggants such as mecury-containing compounds.

SUMMARY OF THE INVENTION

In one aspect, this invention is directed to a process for precipitating a high chloride silver halide emulsion in an aqueous medium comprising growing nucleated silver halide grains in a reaction vessel in the presence of a peptizer comprising a water dispersable starch to form high chloride radiation-sensitive silver halide grains, wherein the majority of grain growth in the reaction vessel is performed at a pH of less than 3.5. Growth of high chloride silver halide emulsion grains in the presence of a starch peptizer at low pH in accordance with the invention has surprisingly resulted in emulsion grains with lower fog, even in the absence of the use of strong oxidizing agents and antifoggant compounds during grain precipitation.

DETAILED DESCRIPTION OF THE INVENTION

The present invention is generally applicable to the precipitation of high chloride silver halide emulsions carried out by the reaction of soluble halide salt and a soluble silver salt in the presence of water-dispersable starch as a peptizer. The term high chloride is used to define a silver halide emulsion comprising greater than 50 preferably at least 70 and optimally at least 90) mole percent chloride, based on silver, with any remaining halide being bromide, iodide, or mixtures thereof. Iodide can be present in levels up to saturation, but is preferably limited to less than 10 mole percent, based on silver. Silver chloride, bromochloride, iodobromochloride, bromoiodochloride and iodochloride emulsions are contemplated. Any form of starch can be used as a peptizer providing that it is water-dispersable in the concentrations necessary to provide protection of the grains from coalescence or flocculation.

The term "starch" is employed to include both natural starch and modified derivatives, such as dextrinated, hydrolyzed, alkylated, hydroxyalkylated, acetylated or fractionated starch. The starch can be of any origin, such as corn starch, wheat starch, potato starch, tapioca starch, sago starch, rice starch, waxy corn starch or high amylose corn starch. Illustrations of varied types of starch are set out by Whistler et al *Starch Chemistry and Technology*, $2^{nd}$ Ed., Academic Press, 1984. Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

(I)

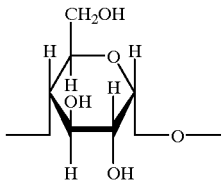

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

To be useful as a peptizer the starch must be water dispersible. Many starches disperse in water upon heating to temperatures up to boiling for a short time (e.g., 5 to 30 minutes). High sheer mixing also facilitates starch dispersion. The presence of ionic substituents increases the polar character of the starch molecule and facilitates dispersion. The starch molecules preferably achieve at least a colloidal level of dispersion and ideally are dispersed at a molecular level—i.e., dissolved.

The conventional procedures for the precipitation of radiation-sensitive silver halide emulsions employing organic peptizers, such as gelatin, gelatin derivative, starch and cellulose derivative peptizers, modified only by the substitution of starch in like amounts for the conventional peptizer and growth of the emulsion grains at low pH, can be employed in the practice of the invention. Grain nucleation and subsequent growth during the precipitation process may occur in the same or separate reaction vessels. In the context of the preparation of emulsions the term "nucleation" refers to that stage of the precipitation or preparation process in which stable new silver halide grains are being formed or otherwise introduced into the reaction vessel. The term "growth" refers to that portion of the precipitation or preparation process in which existing silver halide grains are being increased in size in the reaction vessel. Growth of existing grains may occur with or without an additional stable grain population being introduced or formed, resulting in relatively polydisperse or monodisperse emulsion grain sizes. A summary of conventional emulsion precipitations can be found in *Research Disclosure*, Item 36544, cited above, Section I, Emulsion grains and their preparation. Starch peptizer concentrations of from 0.1 to 10 percent, by weight, more preferably 0.5 to 4 percent, based on the total weight of emulsion as prepared by precipitation, can typically be employed. Mixtures of water-dispersable starches are also contemplated as peptizers within the invention as equivalent to starch from a single source.

High chloride emulsions prepared in accordance with the invention can include coarse, medium or fine silver halide grains and can be prepared by a variety of techniques, e.g., single-jet, double-jet (including continuous removal techniques) accelerated flow rate and interrupted precipitation techniques. High chloride emulsion grains typically favor {100} faces. Emulsion grains prepared in accordance with the invention can vary in size from Lippmann sizes up to the largest photographically useful tabular grain sizes. For tabular grain emulsions, average maximum useful sizes range up to equivalent circular diameters (ECD's) of 10 $\mu$m. However, tabular grains rarely have average ECD's in excess of 5 $\mu$m. A tabular grain is one which has two parallel major faces that are clearly larger than any other crystal face and which has an aspect ratio of at least 2. The term "aspect ratio" is the ratio of the equivalent circular diameter (ECD) of the grain divided by its thickness (the distance separating the major faces). Tabular grain emulsions are those in which tabular grains account for greater than 50 percent of total grain projected area. Nontabular grains seldom exhibit grain sizes in excess of 2 $\mu$m. Emulsions having different grain sizes and halide compositions can of course be blended to achieve desired effects.

In accordance with the invention, the majority (i.e., at least 50 mole percent) of grain growth during emulsion grain precipitation in the reaction vessel, and preferably precipitation of greater than 70 mole % (more preferably greater than 90 mole %) of the emulsion grains based on total silver, is performed at a relatively low pH of less than 3.5, preferably less than or equal to 3.0, more preferably less than or equal to 2.5 and most preferably less than or equal to 2.0. While the use of a low pH environment with starch peptizers during grain growth may result in starch hydrolysis leading to the formation of additional aldehyde groups (which are believed to reduce silver ions to generate fog silver centers in emulsion grains), growth of high chloride silver halide emulsion grains at low pH in the presence of a starch peptizer has surprisingly resulted in fewer fog generating grains, even in the absence of use of a strong oxidizing agent during emulsion grain precipitation as was previously thought required to oxidize silver fog centers as they are formed. Maintenance of a low pH environment during grain growth in accordance with the invention is believed to sufficiently suppress the silver ion reduction reaction such that silver centers are not formed at photographically harmful levels, leading to low fog emulsions. As such, in accordance with preferred embodiments of the invention, the use of antifoggants such as mercury salts and/or the addition or generation of strong oxidizing agents in the reaction vessel to raise the oxidation potential above levels believed required to oxidize internal silver centers (i.e., at least 650 mV (Ag/AgCl ref.)) during grain growth is not needed. While establishing a relatively low pH value is advantageous during grain growth, extremely low pH would be expected to degrade the starch peptizer, therefore a pH value of at least 1.0 is also preferred.

In the preparation of silver halide emulsions other than tabular grain emulsions, the starch peptizer can be cationic, anionic or non-ionic. It is preferred, however, in connection with silver halide grain precipitation generally, and typically necessary in preparing tabular grain emulsions, to employ a water dispersible starch or derivative as a peptizer that is cationic, i.e., that contains an overall net positive charge when dispersed in water. Starches are conventionally rendered cationic by attaching a cationic substituent to at least a portion of the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

The following teachings, the disclosures of which are here incorporated by reference, illustrate water dispersible cationic starches within the contemplation of preferred embodiments of the invention:

*Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
*Barber et al U.S. Pat. No. 3,219,518;
*Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
*Dishburger et al U.S. Pat. No. 3,467,608;
*Beaninga et al U.S. Pat. No. 3,467,647;
Brown et al U.S. Pat. No. 3,671,310;
Cescato U.S. Pat. No. 3,706,584;
Jarowenko et al U.S. Pat. No. 3,737,370;
*Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
*Tsai et al U.S. Pat. No. 5,227,481; and
*Tsai et al U.S. Pat. No. 5,349,089.

It is further preferred to employ an oxidized starch as the starch peptizer, and in particular an oxidized cationic starch. The starch can be oxidized before (* patents above) or following the addition of cationic substituents. This may be accomplished by treating the starch with a strong oxidizing agent. Both hypochlorite ($ClO^-$) or periodate ($IO_4^-$) have been extensively used and investigated in the preparation of commercial starch derivatives and are preferred. While any convenient oxidizing agent counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are usually at the 2 and 3 position carbon atoms forming the α-D-glucopyranose ring. The 2 and 3 position

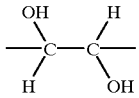

groups are commonly referred to as the glycol groups. The carbon-to-carbon bond between the glycol groups is replaced in the following manner:

(II)

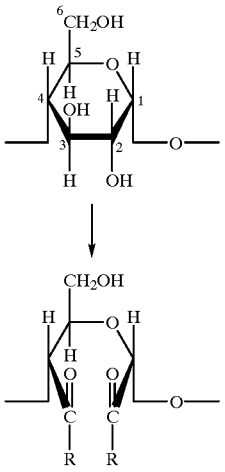

where R represents the atoms completing an aldehyde group or a carboxyl group.

The hypochlorite oxidation of starch is most extensively employed in commercial use. The hypochlorite is used in small quantities to modify impurities in starch. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3 and 6 positions, forming mixtures of carbonyl and carboxyl groups, i.e., aldehydes, ketones, and carboxylic acid groups. Oxidation is conducted at mildly acidic and alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Cescato U.S. Pat. No. 3,706,584, the disclosure of which is here incorporated by reference, discloses techniques for the hypochlorite oxidation of cationic starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations, *Journal Amer. Chem. Soc.*, Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of polymer Science*, Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science: Part A*, Vol. 1, pp. 2601–2620 (1963); K .F. Patel, H. U. Mehta and H. C. Srivastava, "Kinetics and Mechanism of Oxidation of Starch with Sodium Hypochlorite", *Journal of Applied Polymer Science*, Vol. 18, pp. 389–399 (1974); R. L. Whistler, J. N. Bemiller and E. F. Paschall, *Starch: Chemistry and Technology*, Chapter X, Starch Derivatives: Production and Uses, II. Hypochlorite-Oxidized Starches, pp. 315–323, Academic Press, 1984; and O. B. Wurzburg, *Modified Starches: Properties and Uses*, III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J Chem.*, Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidized Polysaccharides. Part II. The Structure of some Nitrogen-containing Polymers", *Journal Amer. Chem. Soc.*, 1953, pp. 3631–3635; P. J. Borchert and J. Mirza, "Cationic Dispersions of Dialdehyde Starch I. Theory and Preparation", *Tappi*, Vol. 47, No. 9, pp. 525–528 (1964); J. E. McCormick, "Properties of Periodate-oxidized Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, *Modified Starches: Properties and Uses*, III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.*, Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized cationic starch is dispersed in a solute during oxidation, it can be separated using conventional ultrafiltration techniques, since there is a large molecular size separation between the oxidized cationic starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated for oxidized starches in accordance with preferred embodiments is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one αD-glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the cationic starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). A typical convenient range of oxidation ring-opens from 3 to 50 percent of the α-D-glucopyranose rings.

In substituting oxidized cationic starch for conventional organic peptizers in accordance with preferred embodiments of the invention, a few significant differences can be observed. First, whereas conventionally silver halide precipitations are conducted in the temperature range of from 30 to 90° C., in the preparation of emulsions with starch peptizers the temperature of precipitation can range down to room temperature or even below. For example, precipitation temperatures as low as 0° C. are within the contemplation of the invention. Unlike conventional peptizers such as gelatino-peptizers, oxidized cationic starch does not "set up" at reduced temperatures. That is, the viscosity of the aqueous dispersing medium containing the cationic starch remains low. Additionally, starch, unlike gelatin, also advantageously has adequate stability at the combination of high acidity and high emulsion precipitation temperatures.

It is an advantage of the invention that low pH during emulsion grain precipitation employing starch peptizers has been found to result in relatively clean (i.e., low fog) emulsions even in the absence of the use of oxidizing agents sufficiently strong to oxidize silver fog centers. If desired, however, such oxidizing agents may additionally be used during or after emulsion grain precipitation to oxidize any silver fog centers which may be formed. The effectiveness of an oxidizing agent depends on the minimum oxidation potential required to oxidize any silver fog centers that are present. Surface image fog, if free of gold, can be removed by oxidizing solutions only a little more positive than the macroscopic electrochemical (Ag+/Ag) equilibrium potential. The oxidation of internal silver centers, however, requires significantly higher oxidation potentials than surface silver centers. In contrast to surface-image (surface-fog centers), internal-image (internal-fog centers) are surrounded by silver halide so their oxidation has to take place indirectly by and through the silver halide phase. In a study examining the oxidation of gold-free internally light fogged core-shell AgCl and AgBr cubic emulsions (R. Matejec and E. Moisar, Photogr. Korr., 101:53 (1964)), it was reported that only in the case of very positive oxidation potentials could a degradation of the internal fog be seen. To obtain maximal bleaching effect on the internal fog generally required bathing of the emulsion coatings in solutions having potentials of at least 650 mV (when converted to Ag/AgCl as reference electrode).

As taught in copending, commonly assigned, concurrently filed U.S. Ser. No. 09/731,445, the disclosure of which is incorporated herein by reference, it is an additional advantage of low pH conditions that an unexpectedly significant reduction in the rate of reaction between strong oxidants, such as bromine, and starch can reduce the amount of oxidizing agent which must be added during the course of or after precipitation to achieve and maintain a desired high oxidation potential sufficient to oxidize silver metal fog centers which may be formed during precipitation, particularly internal fog centers. Accordingly, reduced amounts of strong oxidizing agents (such as bromine or bromine-generating compounds) which are capable of establishing an oxidation potential of at least 650 mV (Ag/AgCl ref.) may be added to the reaction vessel during or after at least a part of the precipitation of the starch peptized emulsion grains, at relatively low pH (e.g., concentrations of oxidizing agent added to the emulsion may be preferably reduced to a level sufficient to provide an equivalent of from $1\times10^{-6}$ to $1\times10^{-3}$ mole elemental bromine per mole of precipitated silver halide and still be effective to establish an oxidation potential of above 650 mV, where the silver basis is the total silver at the conclusion of precipitation of the high bromide emulsion). As explained above, such high oxidation potentials are generally sufficient to bleach internal as well as surface fog centers which may be formed during emulsion grain precipitation. In accordance with preferred embodiments of the present invention, however, such strong oxidizing agents generally need not be employed at any significant level (e.g., concentrations of oxidizing agent added which provide an equivalent of less than $1\times10^{-6}$ mole elemental bromine per mole of precipitated silver halide) to avoid formation of silver metal fog centers during emulsion grain precipitation at relatively low pH, and the oxidation potential accordingly need not be above 650 mV during the majority of grain growth.

In accordance with a preferred embodiment of the invention, starch may be employed as a peptizer in the preparation of cubical grain high chloride emulsions which may contain bromide and/or iodide, and in particular cubical grain silver iodo-chloride high chloride emulsions with iodide placements that produce increased photographic sensitivity. Representative patents directed towards the preparation of high chloride cubical grain emulsions, and in particular silver iodochloride cubical grain emulsions, include U.S. Pat. Nos. 5,830,631, 5,750,324, 5,736,310, 5,728,516, 5,726,005, 5,605,789, 5,550,013, and 5,547,827, the disclosures of which are incorporated by reference. In one aspect this embodiment of the invention is directed to a radiation-sensitive emulsion comprised of a dispersing medium and silver iodochloride grains wherein the silver iodochloride grains are comprised of three pairs of equidistantly spaced parallel {100} crystal faces and contain from 0.05 to 3 mole percent iodide, based on total silver, in a controlled, non-uniform iodide distribution forming a core containing at least 50 percent of total silver, an iodide free surface shell having a thickness of greater than 50 angstoms, and a sub-surface shell that contains a maximum iodide concentration. Such emulsions can be undertaken by employing any convenient conventional high chloride cubical grain precipitation procedure prior to precipitating a region of maximum iodide concentration—that is, through the introduction of at least the first 50 (preferably at least the first 85) percent of silver precipitation. The initially formed high chloride cubical grains then serve as hosts for further grain growth. In one specifically contemplated preferred form the host emulsion is a monodisperse silver chloride cubic grain emulsion. Low levels of iodide and/or bromide, consistent with the overall composition requirements of the grains, can also be tolerated within the host grains. The host grains can include other cubical forms, such as tetradecahedral forms. Techniques for forming emulsions satisfying the host grain requirements of the preparation process are well known in the art. For example, prior to growth of a maximum iodide concentration region of the grains, the precipitation procedures of Atwell U.S. Pat. No. 4,269,927, Tanaka EPO 0 080 905, Hasebe et al U.S. Pat. No. 4,865,962, Asami EPO 0 295 439, Suzumoto et al U.S. Pat. No. 5,252,454 or Ohshima et al U.S. Pat. No. 5,252,456, the disclosures of which are here incorporated by reference, can be employed, but with those portions of the preparation procedures, when present, that place bromide ion at or near the surface of the grains being omitted, and the use of starch as a peptizer in place of gelatin. Stated another way, the host grains can be prepared employing the general precipitation procedures taught by the citations above through the precipitation of the highest chloride concentration regions of the grains they prepare.

Once a host grain population has been prepared accounting for at least 50 percent (preferably at least 85 percent) of total silver has been precipitated, an increased concentration of iodide may be introduced into the emulsion to form the region of the grains containing a maximum iodide concentration. The iodide ion is preferably introduced as a soluble salt, such as an ammonium or alkali metal iodide salt, but may also be added in the form of fine silver iodide grains. The iodide ion can be introduced concurrently with the addition of silver and/or chloride ion. Alternatively, the iodide ion can be introduced alone followed promptly by silver ion introduction with or without further chloride ion introduction. It is preferred to grow the maximum iodide concentration region on the surface of the host grains rather than to introduce a maximum iodide concentration region exclusively by displacing chloride ion adjacent the surfaces of the host grains.

To maximize the localization of crystal lattice variances produced by iodide incorporation it is preferred that the iodide ion be introduced as rapidly as possible. That is, the iodide ion forming the maximum iodide concentration region of the grains is preferably introduced in less than 30 seconds, optimally in less than 10 second. When the iodide is introduced more slowly, somewhat higher amounts of iodide (but still within the ranges set out above) are required to achieve speed increases equal to those obtained by more rapid iodide introduction and minimum density levels are somewhat higher. Slower iodide additions are manipulatively simpler to accomplish, particularly in larger batch size emulsion preparations. Hence, adding iodide over a period of at least 1 minute (preferably at least 2 minutes) and, preferably, during the concurrent introduction of silver is specifically contemplated.

It has been observed that when iodide is added more slowly, preferably over a span of at least 1 minute (preferably at least 2 minutes) and in a concentration of greater than 5 mole percent, based the concentration of silver concurrently added, the advantage can be realized of decreasing grain-to-grain variances in the emulsion. For example, well defined tetradecahedral grains have been prepared when iodide is introduced more slowly and maintained above the stated concentration level. It is believed that at concentrations of greater than 5 mole percent the iodide is acting to promote the emergence of {111} crystal faces. Any local iodide concentration level can be employed up to the saturation level of iodide in silver chloride, typically about 13 mole percent. Maskasky U.S. Pat. No. 5,288,603, here incorporated by reference, discusses iodide saturation levels in silver chloride.

Further grain growth following precipitation of the maximum iodide concentration region can be undertaken by any convenient conventional technique. Conventional double-jet introductions of soluble silver and chloride salts can precipitate silver chloride as a surface shell. Alternatively, particularly where a relatively thin surface shell is contemplated, a soluble silver salt can be introduced alone, with additional chloride ion being provided by the dispersing medium.

At the conclusion of grain precipitation the cubical high chloride grains can take varied forms, ranging from cubic grains (bounded entirely by six {100} crystal faces), grains having an occasional identifiable {111} face in addition to six {100} crystal faces, and, at the opposite extreme, tetradecahedral grains having six {100} and eight {111} crystal faces. After examining the performance of emulsions exhibiting varied cubical grain shapes, it has been concluded that the performance of these emulsions is principally determined by iodide incorporation and the uniformity of grain size dispersity. The preferred silver iodochloride grains are relatively monodisperse, and preferably exhibit a grain size coefficient of variation of less than 35 percent and optimally less than 25 percent. Much lower grain size coefficients of variation can be realized, but progressively smaller incremental advantages are realized as dispersity is minimized.

High chloride emulsions grains prepared in accordance with a further embodiment of the invention may comprise tabular grains, wherein starch (preferably cationic) is substituted for gelatin in conventional emulsion grain precipitation processes. A summary of tabular grain emulsions is contained in *Research Disclosure*, Item 38957, cited above, I. Emulsion grains and their preparation, B. Grain morphology, particularly sub-paragraphs (1) and (3). Although tabular grain emulsions can be selected to provide a variety of performance advantages, depending upon the photographic application to be served, in their most commonly used form tabular grain emulsions have typically contained tabular grains that have major faces lying in {111} crystal lattice planes and contain greater than 50 mole percent bromide, based on silver, as initially commercial interest focused on achieving the highest attainable photographic speeds with minimal attendant granularity. Kofron et al U.S. Pat. No. 4,439,520 illustrates the first chemically and spectrally sensitized high aspect ratio (average aspect ratio >8) tabular grain emulsions. More recently, however, interest has developed in the higher rates of processing and greater ecological compatibility of high chloride emulsions.

The first high chloride tabular grain emulsions contained {111} tabular grains, as illustrated by Wey U.S. Pat. No. 4,399,215 and Maskasky U.S. Pat. No. 4,400,463. Subsequently, attempts at providing high chloride {111} tabular emulsions have focused on improved grain growth modifiers and methods of morphological stabilization by providing various organic compounds which serve to better direct grain growth towards {111} tabular forms and to stabilize the grain surface as described, inter alia, at Jones, U.S. Pat. No. 5,176,991, Maskasky, U.S. Pat. No. 5,176,992 or Nishikawa, U.S. Pat. No. 4,952,491. While the grain growth control and morphological stability of the high chloride {111} tabular emulsions have been greatly advanced by these techniques, the use of grain growth modifier complicates post-precipitation preparation of the grains for imaging, particularly chemical and spectral sensitization. It has also been reported by Houle et al, U.S. Pat. No. 5,035,992, that improved morphological stability can be achieved with high chloride {111} grains of various morphologies by the expedient of incorporating a bromide or iodide band. Additional examples of bromide or iodide stabilized {111} high chloride tabular grain emulsions are illustrated at Maskasky, U.S. Pat. Nos. 5,217,858 and 5,389,509.

In a particular embodiment, the invention is directed towards the preparation of high chloride {100} tabular grain emulsions employing a starch derived peptizer. The more recent discovery of high chloride {100} tabular grain emulsions as illustrated by Maskasky U.S. Pat. Nos. 5,292,632 and 5,275,930, Szajewski U.S. Pat. No. 5,310,635, Brust et al U.S. Pat. No. 5,314,798, House et al U.S. Pat. No. 5,320,938, Chang et al U.S. Pat. No. 5,413,904, and Yamashita et al U.S. Pat. No. 5,498,511, the disclosures of which are incorporated by reference, overcome the problem of high chloride {111} tabular grain morphological instability by providing high chloride emulsions with morphologically stable {100} tabular grain major faces. The high chloride {100} tabular grain population contains greater than 50 mole percent chloride, based on total silver. Thus, the silver halide content of the grain population can consist essentially of silver chloride as the sole silver halide. Alternatively, the grain population can consist essentially of silver bromochloride, where bromide ion accounts for up to 50 mole percent of the silver halide, based on total silver. Preferred emulsions contain less than 20 mole percent bromide, optimally less than 10 mole percent bromide, based on total silver. Silver iodo-chloride and silver iodobromochloride emulsions are also within the contemplation of the invention. Conventional procedures for high chloride {100} tabular grain emulsion preparation as referenced above through the completion of tabular grain growth can be modified merely by the substitution of starch derived peptizer for the disclosed gelatino-peptizers as taught, e.g., in U.S. Pat. No. 5,607,828, in combination with low pH. Precipitation techniques include those that employ iodide during grain nucleation (e.g., House et al) or immediately following grain nucleation (e.g., Chang et al), or that withhold the introduction of iodide during grain nucleation and rely instead upon adsorbed grain growth modifiers to provide the formation of high chloride {100} tabular grains (e.g., Maskasky), or that otherwise promote {100} tabular growth (e.g., the introduction of silver bromide after grain nucleation to create a halide gap that is responsible for tabular grain growth as described in Yamashita et al). In addition, Maskasky U.S. Pat. No. 5,292,632 in Example 6 demonstrates that neither iodide nor a grain growth modifier are necessary to the precipitation of high chloride {100} tabular grain emulsions, although the percentage of total grain projected area accounted by high chloride {100} tabular grains is not as high as demonstrated with the other preparation techniques.

High chloride tabular grain emulsions can exhibit mean grain ECD's of any conventional value, ranging up to 10 $\mu$m, which is generally accepted as the maximum mean grain size compatible with photographic utility. In practice, the tabular grain emulsions typically exhibit a mean ECD in the range of from about 0.2 to 7.0 $\mu$m. Tabular grain thicknesses typically range from about 0.03 $\mu$m to 0.3 $\mu$m. For blue recording somewhat thicker grains, up to about 0.5 $\mu$m, can be employed. For minus blue (red and/or green) recording, thin (<0.2 $\mu$m) tabular grains are preferred. The advantages that tabular grains impart to emulsions generally increases as the average aspect ratio or tabularity of the tabular grain emulsions increases. Both aspect ratio (ECD/t) and tabularity (ECD/$t^2$, where ECD and t are measured in $\mu$m) increase as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.3 $\mu$m preferably less than 0.2 $\mu$m and optionally less than 0.07 $\mu$m) and accounting for greater than 50 percent (preferably at least 70 percent and optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80. Tabularities of >25 are generally preferred.

It is well understood in the art that low bromide and/or iodide concentrations at grain surfaces can significantly improve the properties of high chloride grains for photographic purposes such as spectral sensitization. Bromide and/or iodide added for the purpose of improving sensitization can usefully be precipitated onto the surface of a previously formed tabular grain population—e.g., a silver chloride tabular grain population. Significant photographic advantages can be realized with bromide or iodide concentrations as low as 0.1 mole percent, based on total silver, with minimum concentrations preferably being at least 0.5 mole percent.

Preferably precipitation of high chloride emulsion grains in accordance with the invention is conducted by substituting a water dispersible cationic starch for all conventional gelatino-peptizers. In substituting the selected starch peptizer for conventional gelatino-peptizers, the concentrations of the starch peptizer and the point or points of addition can correspond to those typically employed using gelatino-peptizers. In addition, it has been discovered that emulsion precipitation employing a starch peptizer can tolerate even higher concentrations of the selected peptizer than typically may be employed for gelatino-peptizers. For example, it has been observed that all of the selected peptizer required for the preparation of an emulsion through the step of chemical sensitization can be present in the reaction vessel prior to grain nucleation. This has the advantage that no peptizer additions need be interected after tabular grain precipitation has commenced. It is generally preferred that from 1 to 500 grams (most preferably from 5 to 100 grams) of the selected peptizer per mole of silver to be precipitated be present in the reaction vessel prior to grain nucleation. At the other extreme, it is, of course, well known, as illustrated by Mignot U.S. Pat. No. 4,334,012, here incorporated by reference, that no peptizer is required to be present during grain nucleation, and, if desired, addition of the selected peptizer can be deferred until grain growth has progressed to the point that peptizer is actually required to avoid grain agglomeration.

Conventional dopants can be incorporated into the high chloride grains during their precipitation, as illustrated by the patents cited above and *Research Disclosure*, Item 38957, cited above, Section I. Emulsion grains and their preparation, D. Grain modifying conditions and adjustments, paragraphs (3), (4) and (5). It is specifically contemplated to incorporate shallow electron trapping (SET) site providing dopants in the grains, further disclosed in *Research Disclosure*, Vol. 367, November 1994, Item 36736, and Olm et al U.S. Pat. No. 5,576,171, here incorporated by reference. Because starch is substantially free of nitrogen and sulfur containing material, which may form stable complexes with some metals, it may be possible in the absence of such complexing peptizers to more readily incorporate certain metals into the grains, e.g, platinum, palladium, iron, copper, and nickel compounds. Because some dopants may be subject to oxidative destruction, it is a further advantage of the invention that the use of strong oxidizing agents during grain growth at low pH is not required in the preparation of clean emulsion grains. If a strong oxidizing agent is used during precipitation, it may be preferred to delay such use until after the dopants are incorporated.

It is also recognized that silver salts can be epitaxially grown onto the emulsion grains during the precipitation process. Epitaxial deposition onto the edges and/or corners of tabular grains, e.g., is specifically taught by Maskasky U.S. Pat. No. 4,435,501, Daubendiek et al U.S. Pat. Nos. 5,573,902 and 5,576,168, and Maskasky U.S. Pat. No. 5,275,930 here incorporated by reference. Maskasky U.S. Pat. No. 5,275,930 specifically discloses chemically sensitized high chloride {100} tabular grain emulsion, wherein chemically sensitized silver halide epitaxial deposits containing less than 75 percent of the chloride ion concentration of the tabular grains and accounting for less than 20 percent of total silver are located at one or more of the corners of tabular grains. The emulsions were prepared by first forming the host silver chloride grains, epitaxially depositing silver bromide, adsorbing a photographically useful compound to the surfaces of silver halide epitaxial deposits, and chemically digesting the emulsion.

Although epitaxy onto the host grains can itself act as a sensitizer, emulsions prepared in accordance with the invention can provide sensitivity enhancements with or without epitaxy when chemically sensitized employing one or a combination of noble metal, middle chalcogen (sulfur, selenium and/or tellurium) and reduction chemical sensitization techniques. Conventional chemical sensitizations by these techniques are summarized in *Research Disclosure*, Item 38957, cited above, Section IV. Chemical sensitizations. It is preferred to employ at least one of noble metal (typically gold) and middle chalcogen (typically sulfur) and, most preferably, a combination of both (e.g., aurous sulfide) in preparing the emulsions of the invention for photographic use. The use of a cationic starch peptizer in accordance with preferred embodiments of the invention allows distinct advantages relating to chemical sensitization to be realized. Under comparable levels of chemical sensitization higher photographic speeds can be realized using cationic starch peptizers. When comparable photographic speeds are sought, a cationic starch peptizer in the absence of gelatin allows lower levels of chemical sensitizers to be employed and results in better incubation keeping. When chemical sensitizer levels remain unchanged, speeds equal to those obtained using gelatino-peptizers can be achieved at lower precipitation and/or sensitization temperatures, thereby avoiding unwanted grain ripening.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure*, Vol. 102, October 1972, Item 10208, Hagemaier et al *Research Disclosure*, Vol. 131, March 1975, Item 13122, Bonnet *Research Disclosure*, Vol. 135, July 1975, Item 13577, Berg et al German OLS 2,436,461 and Bolton U.S. Pat. No. 2,495,918, orby employing an ion-exchange resin, as illustrated by Maley U.S. Pat. No. 3,782,953 and Noble U.S. Pat. No. 2,827,428. In washing by these techniques there is no possibility of removing the preferred cationic starch peptizers, since ion removal is inherently limited to removing much lower molecular weight solute ions. Further, it is often convenient to add gelatin to the emulsion after washing so that it can be chill set. In such case, it is preferable to add gelatin in the form of a solution that has been pre-adjusted to the desired low pH.

The starch peptized high chloride emulsion which are precipitated at low pH (i.e., less than 3.5, preferably less than or equal to 3.0, more preferably less than or equal to 2.5 and most preferably less than or equal to 2.0) in accordance with the invention may be stored until they are chemically or spectrally sensitized. Such storage may be performed at similarly low pH to prevent generation of fog silver centers after precipitation. In addition, the high chloride grains may also be used in combination with conventional chemical and/or spectral sensitizers, and may also include one or more conventional antifoggants and stabilizers. A summary of conventional antifoggants and stabilizers is contained in *Research Disclosure*, Item 38957, VII. Antifoggants and stabilizers. After sensitization, added dyes and conventional antifoggants may provide fog protection at conventional higher pH storage conditions of 5 and above.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Other possible sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

(III)

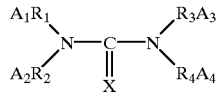

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetra substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(IV)}$$

wherein

L is a mesoionic compound;

X is an anion; and $L^1$ is a Lewis acid donor.

In another preferred form of the invention it is contemplated to employ alone or in combination with sulfur sensitizers, such as those formula III, and/or gold sensitizers, such as those of formula IV, reduction sensitizers which are the 2-[N-(2-alkynyl)amino]-meta-chalcoazoles disclosed by Lok et al U.S. Pat. Nos. 4,378,426 and 4,451,557, the disclosures of which are here incorporated by reference.

The starch-peptized emulsions of this invention can be used in otherwise conventional photographic elements comprising photographic emulsion layers coated on supports to serve varied applications including black-and-white and color photography, either as camera or print materials; image transfer photography; photothermography and radiography. Other sections of Research Disclosure, Item 38957 illustrate features particularly adapting the photographic elements to such varied applications.

The starch peptizer added during emulsion precipitation will typically form only a small portion of the total vehicle of a silver halide emulsion layer in a photographic element. Additional starch of the type used as a peptizer can be added to act as a binder. However, it is preferred to employ as binders other conventional hydrophilic colloid binders, particularly gelatin and gelatin derivatives. Maskasky U.S. Pat. No. 5,726,008, here incorporated by reference, describes a vehicle that can be chill set containing at least 45 percent by gelatin and at least 20 percent of a water dispersible starch. In addition to peptizer and binder, the vehicle is reacted with a hardener to increase its physical integrity as a coating and other addenda, such as latices, are also commonly incorporated. Conventional components which can be included within the vehicle of the emulsion layer summarized in *Research Disclosure*, Item 38957, II. Vehicles, vehicle extenders, vehicle-like addenda and vehicle related addenda and IX. Coating physical property modifying addenda—e.g., coating aids (such as surfactants), plasticizers and lubricants, matting agents and antistats are common vehicle components, conventional choices being illustrated by *Research Disclosure*, Item 38957, IX. Coating physical property modifying addenda.

Photographic element supports can take the form of any conventional support. Typically the support is either transparent (e.g., a transparent film support) or a white reflective support (e.g., a photographic paper support). A listing of photographic element supports is provided in *Research Disclosure*, Item 38957, XV. Supports.

Conventional incorporated dye image providing compounds that can be present in the emulsion layers are summarized in *Research Disclosure*, Item 38957, X. Dye image formers and modifiers. Preferred dye image providing compounds are image dye-forming couplers, illustrated in paragraph B. Dye image providing compounds can be incorporated directly into the emulsion layer or, less commonly, are coated in a conventional vehicle containing layer in reactive association with (usually contiguous to) an emulsion layer. Dye-forming couplers are commonly dispersed in hydrophilic colloid vehicles in high boiling coupler solvents or in latex particles. These and other conventional dispersing techniques are disclosed in paragraph D. Dispersing dyes and dye precursors.

Although *Research Disclosure*, Items 36544 and 38957, have been used to provide specific illustrations of conventional photographic element features as well as their exposure and processing, it is recognized that numerous other publications also disclose conventional features, including the following:

James *The Theory of the Photographic Process*, 4th Ed., Macmillan, New York, 1977;

*The Kirk-Othmer Encyclopedia of Chemical Technology*, John Wiley and Sons, New York, 1993;

Neblette's *Imaging Processes and Materials*, Van Nostrand Reinhold, New York 1988; and Keller, *Science and Technology of Photography*, VCH, New York, 1993.

EXAMPLES

The invention can be better appreciated by reference to the following specific embodiments. Except as otherwise indicated, all weight percentages (wt %) are based on total weight. The suffix "C" is used to identify comparative Examples, which were not prepared in accordance with the invention.

Examples 1 and 2

Starch Made, AgICl (0.2% Iodide) Cubic Grain Emulsions Made at pH 2.0 and Stored at pH 5.6 and 2.0 Respectively.

A starch solution was prepared by heating at 80° C. for 30 min a stirred mixture of 8 L distilled water and 240 g of the oxidized cationic waxy cornstarch STA-LOK 140 (obtained from A. E. Staley Manufacturing Co., Decatur, Ill., which starch derivative is 100% amylopectin that had been treated to contain quaternary ammonium groups, 0.30–0.38 wt % nitrogen, and oxidized with 2 wt % chlorine bleach). After cooling to 40° C., 44 g of NaCl was added and the pH was adjusted to 2.0 with reagent nitric acid.

To the vigorously stirred reaction vessel containing the starch solution at 60° C., pCl of 1.02, and pH 2.0, was added solution Sol-A (4.0 M $AgNO_3$, 0.244 mM $HNO_3$) at 21 mL/min for 1 min then its flow rate was accelerated to 103 mL/min in 50 min and maintained at this flow rate until 3.69 L had been added. The pCl was maintained at 1.02 by the concurrent addition of solution Sol-B (4.19 M NaCl) and the pH was maintained at 2.0 with $HNO_3$ or dilute NaOH solutions as required. Then 0.236 L of Sol-C (0.139 M KI) was added at 200 mL/min. After an additional 1 min, the addition of Sol-A was resumed at 103 mL/min while maintaining the pCl at 1.02 with Sol B and the pH at 2.0 until a total of 16.42 moles of Ag had been added.

The emulsion was cooled to 30° C. and washed by ultra-filtration to a conductivity of 6 mS. The emulsion was divided into 2 equal parts. To each part a pH adjusted 20% bone gelatin solution was added rapidly with good stirring at 40° C. to make a gelatin-to-silver ratio of 40 g gel per mole silver. The pCl was adjusted to 1.57 with NaCl solution. For Example 1 the bone gel solution and the final emulsion were adjusted to a pH of 5.6. For Example 2 the bone gel solution and the final emulsion were adjusted to a pH of 2.0 with $HNO_3$.

The resulting emulsions consisted of cubic grains having an average volume equivalent to a cube edge of length 0.57 $\mu$m.

Control Examples 3C and 4C

Starch Made, AgICl (0.2% Iodide) Cubic Grain Emulsions Made at pH 5.0 and Stored at pH 5.6 and 2.0 Respectively.

These pair of control examples were made similarly to Examples 1 and 2 except that solution Sol-A was 4.0 M $AgNO_3$, 0.118 moles of sodium acetate was added to the reaction vessel prior to the start of the precipitation, and the pH was maintained at pH 5.0 throughout the precipitation.

Control Examples 3C was adjusted to a pH of 5.6 and Control Examples 4C was adjusted to a pH of 2.0 with nitric acid.

The resulting control example emulsions consisted of cubic grains having an average volume equivalent to a cube of edge length 0.58 μm.

Control Examples 5C

Gelatin Made, AgICl (0.2% Iodide) Cubic Grain Emulsion Containing Hg

To the vigorously stirred reaction vessel containing 9.0 Kg of a solution of 251 g bone gelatin and 1.89 g 1,8-dihydroxy-3,6-dithiaoctane at 68° C., adjusted to pCl of 0.84 with NaCl, and pH of 5.5, was added solution Sol-A' (3.72 M $AgNO_3$, 1.0 μM mercuric chloride) at 74 mL/min. The pCl was maintained at 0.84 by the concurrent addition of solution Sol-B' (3.8 M NaCl). The additions were stopped when 3.023 L of Sol-A' had been added. Then 0.062 L of solution Sol-C' (0.400 M KI) was added at 21 mL/min. After an additional 0.5 min, the addition of Sol-A' was resumed at 74 mL/min and Sol-B' as needed to maintaining the pCl at 0.84 until a total of 12.50 moles of silver had been.

The emulsion was cooled to 38° C. and washed by ultra-filtration to a conductivity of 6 mS. Then 1.244 Kg of a 20% gelatin solution was added. The emulsion was adjusted at 40° C. to a pCl of 1.57 and a pH of 5.6.

The resulting emulsion consisted of cubic grains having an average volume equivalent to a cube of edge length 0.66 μm.

Control Examples 6C

Gelatin Made, AgICl (0.2% Iodide) Cubic Grain Emulsion

This emulsion was made similarly to Control Examples 5C except that no mercuric chloride was added.

The resulting emulsion consisted of cubic grains having an average volume equivalent to a cube of edge length 0.67 μm.

Example 7

Starch Made, High-Chloride {100} Tabular-Grain Emulsion, Made and Stored at pH 2.0.

A starch solution was prepared by heating at 80° C. for 30 min a stirred mixture of 0.40 L distilled water and 8 g of the cornstarch STA-LOK 140 (containing 0.29 mmoles of chloride ion per g of starch). After cooling to 40° C., 3.85 g of a 0.50 M NaBr solution was added and the pH was adjusted to 2.0 with reagent nitric acid.

To the vigorously stirred reaction vessel containing the starch solution at 75° C., and pH 2.0, was added solution Sol-A" (4.0 M $AgNO_3$, 1.3 mM $HNO_3$) at 1.3 mL/min until a total of 100 mL had been added. Concurrently a 4 M NaCl solution was added as needed to reach and then maintain a pCl of 1.57.

The emulsion was cooled to 40° C., adjusted to a pCl of 1.57, and filtered through a fine mesh screen. To the emulsion, 100 g of a 14% bone gelatin solution adjusted to a pH of 2.0 with $HNO_3$ was added with good mixing. The emulsion was then adjusted to pH 2.0 and pCl 1.57.

The resulting emulsion consisted of a population of {100} tabular grains that made up 65% of the projected area of the grains. This tabular grain population had an average diameter of 1.3 μm, an average thickness of 0.21 μm and an aspect ratio of 6.2.

Control Example 8C

Starch Made, High-Chloride {100} Tabular-Grain Emulsion, Made at pH 5.0 and Stored at pH 5.6.

This emulsion was made similarly to Example 7C except that 1.5 mmole of sodium acetate was added to the cornstarch solution, solution Sol-A" was 4.0 M $AgNO_3$ , the pH was maintained at 5.0 throughout the precipitation, and the final emulsion was stored at a pH of 5.6.

The resulting emulsion consisted of a population of {100} tabular grains that made up 67% of the projected area of the grains. This tabular grain population had an average diameter of 1.3 μm, an average thickness of 0.21 μm and an aspect ratio of 6.2.

Testing High-Chloride Emulsions for Relative Photographic Speeds and Fog

The fog test is based on the observation that gold only sensitization will cause latent fog centers (silver metal centers) of primitive emulsions to become developable i.e., detectable. The test can be used as a means of distinguishing high chloride emulsions that would have elevated fog levels when chemically sensitized in attempting to achieve maximal photographic speed-fog performance.

A portion of emulsions Examples 1, 2, 3C, 4C, 5C, 6C, 7, and 8C were adjusted to pH 5.6, pCl 1.57 at 40° C. Because high chloride emulsions can be easily fogged, special precautions were used to raise the pH of emulsions that had been stored at low pH. To a portion of a low pH stored emulsion, water was added to dilute the emulsion to 1.30 Kg/mole Ag (except for emulsion Example 7 that was already dilute). The pCl was adjusted to 1.57. With good mixing 0.25 M NaOH was added at a constant rate requiring about 15 min to adjust the pH to 5.6. To a portion of each of the pH adjusted emulsions was added 4.0 mg/Ag mole of potassium tetrachloroaurate and the mixture stirred at 40° C. for 10 min.

Portions of the pH adjusted Au treated and pH adjusted non-Au treated emulsions were diluted with water and coated on a water adsorbent paper support to have a silver lay-down of ~4.74 g/$m^2$, determined by atomic adsorption spectroscopy. All emulsions were tested within 10 days of precipitation.

Relative Photographic Speeds: The coatings of the emulsions were given exposures to 365 nm light through a variable speed shutter producing a variable exposure, and processed in Kodak Dektol Developer for 20 sec. The developed silver density was then read with an infrared reflection densitometer on the coating while still in the developer. The densitometer consisted of two pairs of IR emitters and detectors (one pair used as reference), fiber optic cables, and analog circuitry. The emitters and detectors operated at a wavelength of 940 nm. The relative photographic speeds, measured at 0.2 density above fog, are given in Table I.

Fog Test: The silver metal density produced on an unexposed coating of an emulsion was measured, by infrared reflection using two pairs of IR emitters and detectors located in the Kodak Dektol Developer solution, at 30 sec time of development. This developer would be a developer for both surface and internal fog centers of high chloride emulsions. The fog data for the cubic grain emulsion Examples are given in Table I and for the {100} tabular grain emulsion Examples in Table II.

TABLE I

| Example | Description | pH Making | pH Storage | Gold Treatment | Relative Speed | Speed Gain from Gold | Fog Level |
|---|---|---|---|---|---|---|---|
| 1 | starch | 2.0 | 5.6 | No | 111 | | 0.09 |
| | | | | Yes | 178 | 67 | 0.23 |
| 2 | starch | 2.0 | 2.0 | No | 108 | | 0.09 |
| | | | | Yes | 175 | 67 | 0.13 |
| 3C | starch | 5.0 | 5.6 | No | 121 | | 0.10 |
| | | | | Yes | *fog | *fog | 0.93 |
| 4C | starch | 5.0 | 2.0 | No | 115 | | 0.08 |
| | | | | Yes | 168 | 53 | 0.34 |
| 5C | gelatin, Hg | 5.5 | 5.6 | No | 100 | | 0.15 |
| | | | | Yes | 118 | 18 | 0.17 |
| 6C | gelatin | 5.5 | 5.6 | No | 107 | | 0.18 |
| | | | | Yes | *fog | *fog | 0.85 |

*The speed values were not obtainable for the gold treated control emulsion Examples 3C and 6C because of their high fog levels The speeds reported in Table I are referenced to control emulsion Example 5C without Au treatment. The speed is reported as relative log speed, where a speed difference of 1 is equal to an exposure difference of 0.01 log E, where E represents exposure in lux-seconds. The speed data shows that the two Au treated Example Emulsions 1 and 2 gave higher 365 nm speeds (178 and 175 respectively) than any of the Au treated Control Example Emulsions. Also the speed increases obtained from the Au treatment was greatest for the two Example Emulsions than for the Control Example Emulsions.

The comparison of the fog levels obtained for Control Example 5C (made in gelatin peptizer using Hg antifoggant) with Control Example 6C (made in gelatin with no Hg) clearly shows the benefit of Hg in controlling fog in high chloride emulsions. However, still lower fog levels were obtained for Example 2 of this invention that was made in starch at low pH, stored at low pH and did not use Hg. The Au enhanced fog level was 31% lower than that of Control Example 5C. A comparison of the Au enhanced fog data of Control Example 3C (made in starch at pH 5.0 and stored at pH 5.6) with Example 1 (made in starch at pH 2.0 and stored at pH 5.6) and Control Example 4C (made in starch at pH 5.0 and stored at pH 2.0) with Example 2 (made in starch at pH 2.0 and stored at pH 2.0), show the advantage of making at low pH. The further advantage of low pH storage is apparent from comparing the Au enhanced fog data of Example 1 with Example 2.

TABLE II

| Example | Description | pH Making | pH Storage | Gold Treatment | Fog Level |
|---|---|---|---|---|---|
| 7 | starch | 2.0 | 2.0 | No | 0.36 |
| | | | | Yes | 0.37 |
| 8C | starch | 5.0 | 5.6 | No | 0.83 |
| | | | | Yes | 0.96 |

The data in Table II shows a comparison of high chloride {100} tabular grain emulsions made in starch. Example 7 was made and stored at pH 2.0 while Control Example 8C was made at pH 5.0 and stored at pH 5.6. Control Example 8C showed a 260% increase in Au enhanced fog. This comparison shows the advantage of low pH making and storage of starch made emulsions.

The invention has been described in detail with particular reference to certain preferred embodiments thereof, but it will be understood that variations and modifications can be effected within the spirit and scope of the invention.

What is claimed is:

1. A process for precipitating a high chloride silver halide emulsion in an aqueous medium comprising growing nucleated silver halide grains in a reaction vessel in the presence of a peptizer comprising a water dispersible cationic starch to form high chloride radiation-sensitive silver halide grains, wherein the majority of grain growth in the reaction vessel is performed at a pH of less than 3.5 and the starch peptizer provides protection of the grains from coalescence or flocculation.

2. A process according to claim 1, wherein the radiation-sensitive silver halide grains grown in the reaction vessel comprise high chloride cubical grains.

3. A process according to claim 2, wherein the high chloride grains comprise silver iodochldride grains comprised of three pairs of equidistantly spaced parallel {100} crystal faces and contain from 0.05 to 3 mole percent iodide, based on total silver, in a controlled, non-uniform iodide distribution forming a core containing at least 50 percent of total silver, an iodide free surface shell having a thickness of greater than 50 angstoms, and a sub-surface shell that contains a maximum iodide concentration.

4. A process according to claim 1, wherein (a) the radiation-sensitive silver halide grains grown in the reaction vessel include tabular grains (1) having {100} major faces, (2) containing greater than 50 mole percent chloride, based on silver, and (3) accounting for greater than 50 percent total grain projected area, and (b) the peptizer is a water dispersible cationic starch.

5. A process according to claim 1 wherein the starch contains αD-glucopyranose repeating units and, on average, at least 1 percent of the α-D-glucopyranose repeating units are ring opened by oxidation.

6. A process according to claim 1, wherein the oxidation potential in the reaction vessel is less than 650 mV (Ag/AgCl ref.) during the majority of grain growth in the reaction vessel performed at a pH of less than 3.5.

7. A process according to claim 6, wherein greater than 90 mole % of the emulsion grains is precipitated in the reaction vessel at a pH of from 1.0 to 3.5 and an oxidation potential of less than 650 mV (Ag/AgCl ref.).

8. A process according to claim 6, wherein greater than 90 mole % of the emulsion grains is precipitated in the reaction vessel at a pH of from 1.0 to 3.0 and an oxidation potential of less than 650 mV (Ag/AgCl ref.).

9. A process according to claim 6, wherein greater than 90 mole % of the emulsion grains is precipitated in the reaction vessel at a pH of from 1.0 to 2.5 and an oxidation potential of less than 650 mV (Ag/AgCl ref.).

10. A process according to claim 1, wherein greater than 70 mole % of the emulsion grains is precipitated in the reaction vessel at a pH of from 1.0 to 3.5.

11. A process according to claim 1, wherein greater than 70 mole % of the emulsion grains is precipitated in the reaction vessel at a pH of from 1.0 to 3.0.

12. A process according to claim 1, wherein greater than 70 mole % of the emulsion grains is precipitated in the reaction vessel at a pH of from 1.0 to 2.5.

13. A process according to claim 1, further comprising chemically sensitizing the precipitated silver halide grains, wherein the emulsion is stored at a pH of less than 3.5 between precipitation and chemical sensitization.

14. A high chloride silver halide photographic emulsion comprised of (a) high chloride radiation-sensitive silver halide grains, and (b) peptizer of the silver halide grains comprising a water dispersible cationic starch, wherein the radiation sensitive silver halide grains have been precipitated in a reaction vessel in the presence of the starch peptizer, the majority of grain growth in the reaction vessel was performed at a pH of less than 3.5, and the starch peptizer provides protection of the grains from coalescence or flocculation.

15. An emulsion according to claim 4, stored at a pH of less than 3.5.

* * * * *